US008562503B2

(12) United States Patent
Rudman et al.

(10) Patent No.: US 8,562,503 B2
(45) Date of Patent: Oct. 22, 2013

(54) DISK PACKAGE FOR A CENTRIFUGE ROTOR

(75) Inventors: Lars Johan Rudman, Farsta (SE); Sven Olov Olsson, Huddinge (SE)

(73) Assignee: Alfa Laval Corporate AB, Lund (SE)

( * ) Notice: Subject to any disclaimer, the term of this patent is extended or adjusted under 35 U.S.C. 154(b) by 340 days.

(21) Appl. No.: 13/120,559

(22) PCT Filed: Sep. 30, 2009

(86) PCT No.: PCT/SE2009/051083
§ 371 (c)(1),
(2), (4) Date: May 26, 2011

(87) PCT Pub. No.: WO2010/039095
PCT Pub. Date: Apr. 8, 2010

(65) Prior Publication Data

US 2011/0237417 A1 Sep. 29, 2011

(30) Foreign Application Priority Data

Sep. 30, 2008 (SE) ..... 0802058

(51) Int. Cl.
*B04B 7/14* (2006.01)
*B04B 1/08* (2006.01)

(52) U.S. Cl.
USPC ..... 494/73

(58) Field of Classification Search
USPC ..... 494/64, 67–73
See application file for complete search history.

(56) References Cited

U.S. PATENT DOCUMENTS

| | | | | |
|---|---|---|---|---|
| 694,736 | A * | 3/1902 | Gales | 494/73 |
| 1,006,622 | A | 10/1911 | Bailey | |
| 2,028,955 | A * | 1/1936 | Shenstone | 494/70 |
| 2,725,190 | A * | 11/1955 | Hein et al. | 494/70 |
| 3,335,946 | A * | 8/1967 | Putterlik | 494/73 |
| 4,142,671 | A * | 3/1979 | Ivin et al. | 494/73 |
| 4,262,841 | A * | 4/1981 | Berber et al. | 494/66 |
| 2011/0195832 | A1* | 8/2011 | Rudman et al. | 494/73 |
| 2011/0237417 | A1* | 9/2011 | Rudman et al. | 494/70 |

FOREIGN PATENT DOCUMENTS

| | | | |
|---|---|---|---|
| CH | 651764 | A5 * | 12/1978 |
| DE | 363851 | | 11/1922 |
| SU | 423510 | A1 | 4/1974 |
| WO | 9627445 | | 9/1996 |
| WO | 2007055630 | | 5/2007 |

OTHER PUBLICATIONS

PCT International Preliminary Report on Patentability, International Application No. PCT/SE2009/051083, Date Mailed Apr. 5, 2011.

* cited by examiner

*Primary Examiner* — Charles E Cooley
(74) *Attorney, Agent, or Firm* — MKG, LLC

(57) ABSTRACT

The invention refers to a disk package for a centrifuge. The disk package comprises a plurality of separating disks provided on each other in the disk package. Each separating disk extends around an axis of rotation for the centrifuge rotor and has tapering shape with an inner surface and an outer surface along the axis of rotation. Each separating disk has inner edge, defining a central opening of the separating disk, and outer edge. Each separating disk is manufactured of a material. The separating disks comprise a plurality of first separating disks comprising a number of distance members, which extend away from the inner surface and/or outer surface. Each distance member comprises at least one contact zone abutting an outer surface and inner surface, respectively, of an adjacent separating disk in the disk package. The contact zone has a continuously convex shape seen in a cross section.

17 Claims, 16 Drawing Sheets

DISK PACKAGE FOR A CENTRIFUGE ROTOR

FIELD OF THE INVENTION

The present invention refers to a disk package of a centrifuge rotor of a centrifugal separator adapted for separation of components in a supplied medium, wherein the disk package comprises a plurality of separating disks provided on each.

Today separating disks for disk packages in centrifuge rotors are normally manufactured through pressure turning of plane disks to a desired tapering shape, for instance a conical shape. The distance members, which define the distance between the separating disks in the disk package, are normally formed by loose flat elements which are attached to the outer surface of the separating disks through spot welding. One property of such distance members is that they have a relatively large contact area against the inner surface of the adjacent separating disk in the disk package. Another property is that gaps or thin interspaces are formed between the distance members and the outer surface of the separating disk at which the distance members are welded. Both of these properties contribute to the formation of relatively large areas where particles and microorganisms easily are collected. These areas are also difficult to reach during cleaning of the disk package, which means that in many applications it can be difficult to reach the hygienic requirements called for. Another disadvantage of these known distance members is that the cost for the manufacturing of the separating disk becomes high since each distance member has to be applied afterwards.

Disk packages with conical separating disks of two kinds provided in an alternating order so that every second disk is even and every second disk comprises a number of distance members in the form of projections and depressions in the disk have been known. The projections and depressions have been provided by means of some kind of press method. In one instance, the projections and depressions are defined as comprising a plane portion which is parallel with the disk, i.e. also with this known technique a large contact area between the distance members and the surface of the adjacent separating disk is formed.

Furthermore, the projections and depressions are provided in such a way that a projection is followed by a depression in a radial direction. Furthermore, one projection lies opposite to a depression of an adjacent disk in the disk package so that a pile of alternating projections and depressions through the disk package is formed.

SUMMARY OF THE INVENTION

The object of the present invention is to provide a disk package which can be readily maintained in a clean state and which exhibits good hygienic properties.

In one aspect of the present invention separating disks that are pressed against each other with a pre-tensioning force in such a way that the distance members tightly abut an adjacent separating disk, and that the contact zone has a continuously convex shape as seen in a section so that the contact zone has a contact area approaching zero.

With such a continuously convex shape of the contact zone a small contact area between the contact zone and the adjacent separating disk may be achieved, i.e. the contact area approaches zero. The contact zone can be defined to form a point or line abutment, or substantially a point or line abutment, to the inner surface or outer surface of the adjacent separating disk.

Such a minimized contact area results in good hygienic properties of the disk package since this will be readily cleaned. The minimized contact area reduces the amount of particles and microorganisms, such as bacteria, which can accumulate in the area of the distance members.

According to an embodiment of the present invention, each contact zone has an extension outwardly with respect to the axis of rotation. In such a way, a line abutment, or substantially a line abutment, along the extension of the contact zone is achieved. Along this contact zone, the separating disks may thus lie tightly against each other, which is advantageous for an efficient separation. Each distance member may then have an extension in the proximity of but not from the inner edge to, in the proximity of but not up to the outer edge. Advantageously, the contact zone extends almost the whole, or along substantially the whole, extension of the distance member. The protrusions may at the ends have a soft curved transition to the outer surface and/or the inner surface, wherein the contact zone does not extend along the whole extension of the protrusion.

According to a further embodiment of the invention, the extension of the distance member is substantially straight. According to another embodiment, the extension of the distance member may be curved. The extension of the distance member may for instance extend along a softly curved path which deviates slightly from a radial direction. It is to be noted that also a straight extension may be radial or deviate from a radial direction when the extension is viewed in the direction of the axis of rotation.

According to a further embodiment of the invention, each distance member has a width at the inner surface and/or the outer surface seen in a normal direction to said surface, wherein the width of at least some of the distance members varies with the distance from the axis of rotation. Such a configuration of the width may in certain cases be advantageous, for instance for achieving a high strength of the individual separating disks. It is to be noted, however, that also if the width of the distance member varies, the distance member may still exhibit a contact zone forming a point or line abutment, or substantially a point or line abutment.

According to a further embodiment of the invention, each contact zone has a continuously convex shape seen in a section transversally to a peripheral direction. Such a contact zone is thus continuously convex in all directions and forms a point abutment, or substantially a point abutment, to the adjacent separating disk. Such a point-like extension of the distance members may ensure a proper and supporting abutment of each distance member.

According to a further embodiment of the invention, the distance members comprise a number of pairs of protrusions which each comprising a first protrusion extending away from the outer surface and a second protrusion extending away from the inner surface, wherein the first and second protrusions are displaced in relation to each other in a peripheral direction. The first and second protrusions may be provided adjacent to each other in the peripheral direction.

According to a further embodiment of the invention, the first protrusion forms a channel-like depression of the inner surface, wherein this depression is configured to collect and transport one of said components radially outwardly or inwardly on the inner surface. Furthermore, the second protrusion may form a channel-like depression on the outer surface, wherein this depression is configured to collect and transport one of said components radially outwardly or inwardly on the outer surface.

According to a further embodiment of the invention, the separating disks comprise a plurality of second separating disks, wherein the first and second separating disks are provided in an alternating order in the disk package. The second separating disks may then lack distance members. The second separating disks are thus according to this embodiment, even, in the sense that they do not have any protrusions. The contact zones of each protrusion will thus abut a substantially even outer surface or inner surface of an adjacent separating disk in the disk package.

According to another embodiment of the invention, the distance members comprise protrusions extending in the same direction with respect to the outer surface, wherein each protrusion is delimited by two opposite side lines extending towards an outer edge of the separating disk. In this case, all separating disks, i.e. both the first separating disks and the second separating disks, may be identical.

According to a further embodiment of the invention, the tapering shape and the protrusions of the first separating disks have been provided through pressing of a blank of the material against a tool part having a shape corresponding to the tapering shape with the protrusions of the pressed separating disk. In such a way, the first separating disk may be manufactured in an efficient and advantageous manner with regard to costs.

According to a further embodiment of the invention, the outer surface and/or inner surface of the separating disks have a surface roughness.

BRIEF DESCRIPTION OF THE DRAWINGS

The invention is now to be explained through a description of various embodiments and with reference to the drawings attached hereto.

DETAILED DESCRIPTION OF VARIOUS EMBODIMENTS OF THE INVENTION

Figure 1:
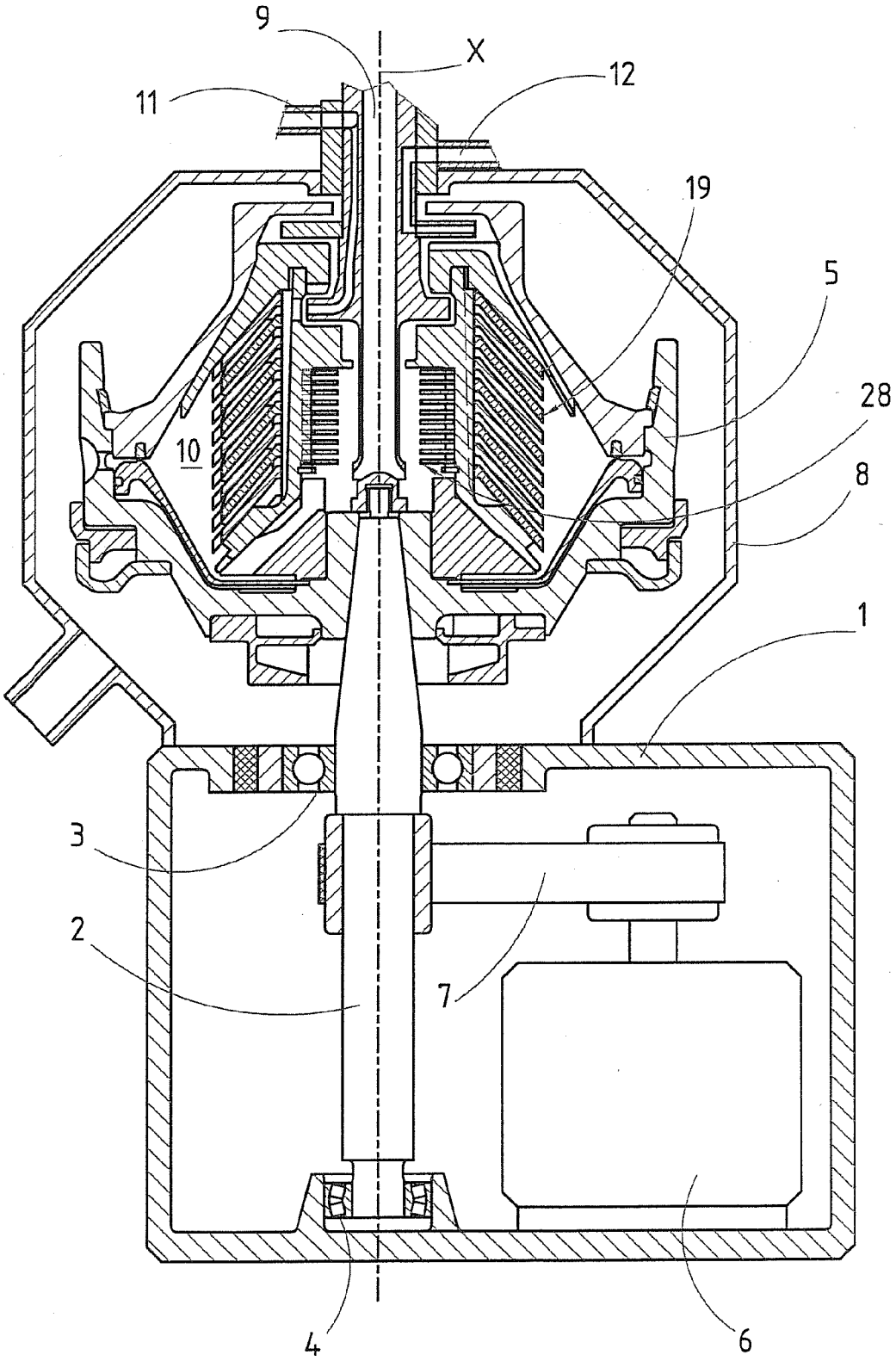
FIG. 1 discloses a partly sectional side view of a centrifugal separator with a centrifuge rotor.

FIG. 1 discloses a centrifugal separator which is adapted for separation of at least a first component and a second component of a supplied medium. It is to be noted that the disclosed centrifugal separator is disclosed as an example and that the configuration thereof may be varied. The centrifugal separator comprises a frame 1, which may be non-rotatable or stationary, and a spindle 2 which is rotatably journalled in an upper bearing 3 and a lower bearing 4. The spindle 2 carries a centrifuge rotor 5 and is arranged to rotate together with the centrifuge rotor 5 around an axis x of rotation in relation to the frame 1. The spindle 2 is driven by means of a drive member 6 which is connected to the spindle 2 in a suitable manner in order to rotate the latter at a high velocity, for instance via a drive belt 7 or a gear transmission, or through direct drive, i.e. the rotor (not disclosed) of the drive member 6 is directly connected to the spindle 2 or the centrifuge rotor 5. It is to be noted here that elements having the same function have been provided with identical reference signs in the various embodiments to be described.

The centrifugal separator may comprise a casing 8 which is connected to the frame 1 and which encloses the centrifuge rotor 5. Furthermore, the centrifugal separator comprises at least one inlet 9, which extends through the casing 8 and into a separation space 10 which is formed by the centrifuge rotor 5 for feeding of the medium to be centrifuged, and at least a first outlet for discharge from the separation space 10 of the first component which has been separated from the medium and a second outlet for discharge from the separation space 10 of the second component which has been separated from the medium.

In the separation space 10, there is a disk package 19 which rotates with the centrifuge rotor 5. The disk package 19 comprises or is assembled of a plurality of separating disks 20 which are stacked onto each other in the disk package 19, see FIG. 2. A separating disk 20 according to a first embodiment is disclosed more closely in FIGS. 3 and 4. Each separating disk 20 extends around the axis x of rotation and rotates around the axis x of rotation in a direction R of rotation. Each separating disk 20 extends along a rotary symmetric, or virtually rotary symmetric, surface which tapers along the axis x of rotation, and has a tapering shape along the axis x of rotation with an outer surface 21, which is convex, and an inner surface 22, which is concave. The tapering shape of the separating disks 20 may also be conical or substantially conical, but it is also possible to let the tapering shape of the separating disks 20 have a generatrix which is curved inwardly or outwardly. The separating disks 20 thus have an angle $\alpha$ of inclination in relation to the axis x of rotation, see FIG. 2. The angle $\alpha$ of inclination may be 20-70°. Each separating disk 20 also has an outer edge 23 along the radially outer periphery of the separating disk 20 and an inner edge 24 which extends along the radially inner periphery of the separating disk 20 and defines a central opening of the separating disk 20.

Figure 5:
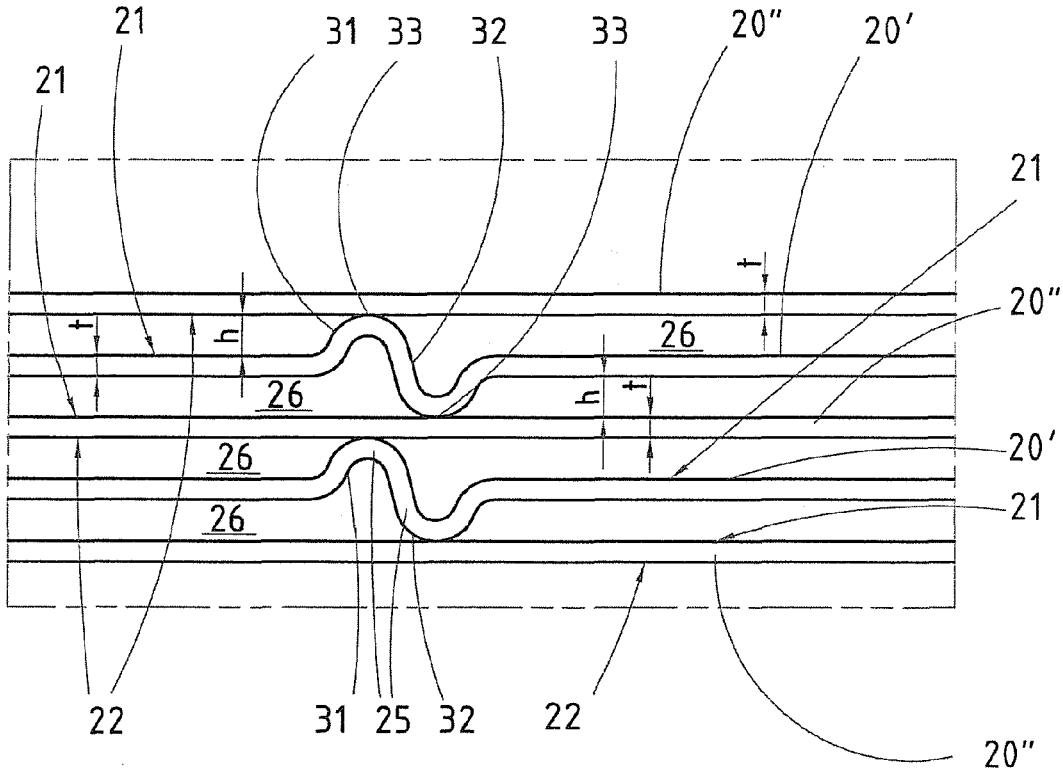
FIG. 5 discloses a section through the disk package in FIG. 2.

Between the separating disks 20, there are distance members 25 which are provided on the outer surface 21 and/or the inner surface 22 and arranged to ensure the formation of an interspace 26 between adjacent separating disks 20 in the disk package 19, see FIG. 5. Each separating disk 20 comprises at least one portion without distance members 25 on the outer surface 21 and/or the inner surface 22. The separating disks 20 may be provided around a distributor 27. The separating disks 20 are compressed against each other in the disk package 19 with a pre-tensioning force in such a way that the distance members 25 of a separating disk abut sealingly an adjacent separating disk 20, especially against the above-mentioned portion of an adjacent separating disk 20. The separating disks 20 may also be fixedly connected to each other, for instance through brazing.

Figure 2:
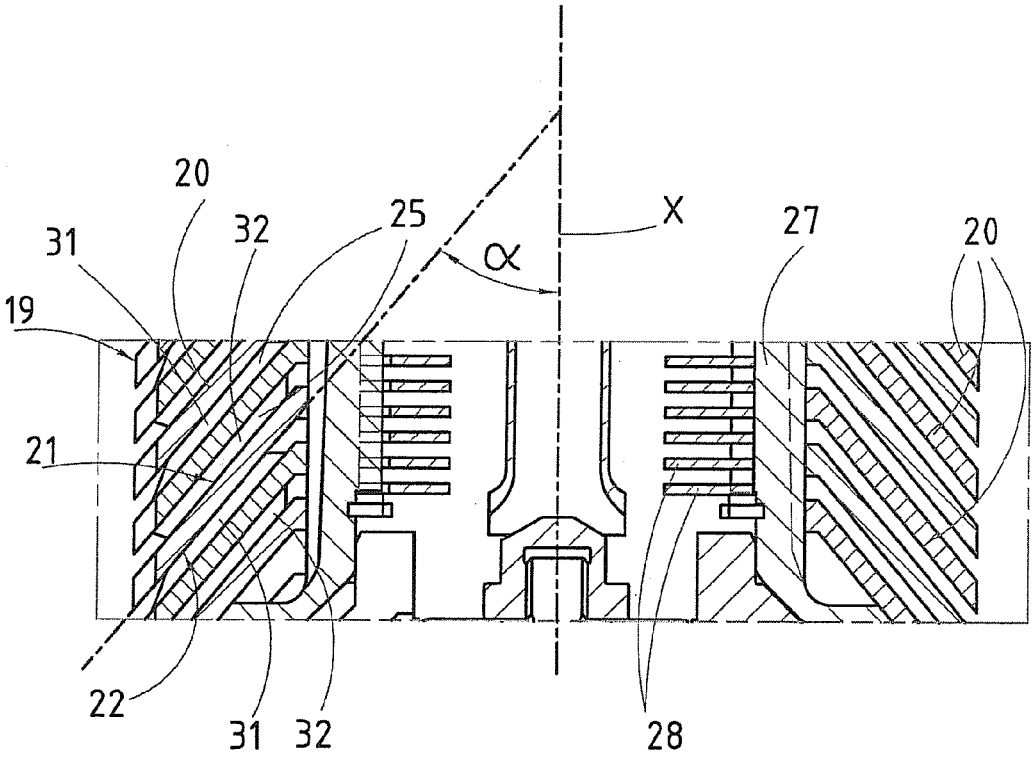
FIG. 2 discloses a sectional side view through a disk package of the centrifugal separator in FIG. 1.

As can be seen in FIGS. 1 and 2, the centrifuge rotor 5 also comprises a number of inlet disks 28 which are centrally provided in the distributor 27. These inlet disks 28 may be manufactured in a similar manner as the separating disks 20. The inlet disks 28 may be plane, as disclosed in FIGS. 1 and 2, or conical. The inlet disks 28 may have distance members with a similar configuration as the distance members 25 of the separating disks 20.

The tapering shape of the separating disks 20 has been provided through pressing of a blank of a material against a tool part. The material may be any pressable material, for instance metal material, such as steel, aluminium, titanium, various alloys etc., and also suitable plastic materials. The tool part to be described more closely below has a shape corresponding to the tapering shape of the pressed separating disk 20. It is to be noted, however, that the separating disks 20 as a consequence of such a pressing may obtain a thickness t that varies with the distance from the axis x of rotation.

Figure 4:
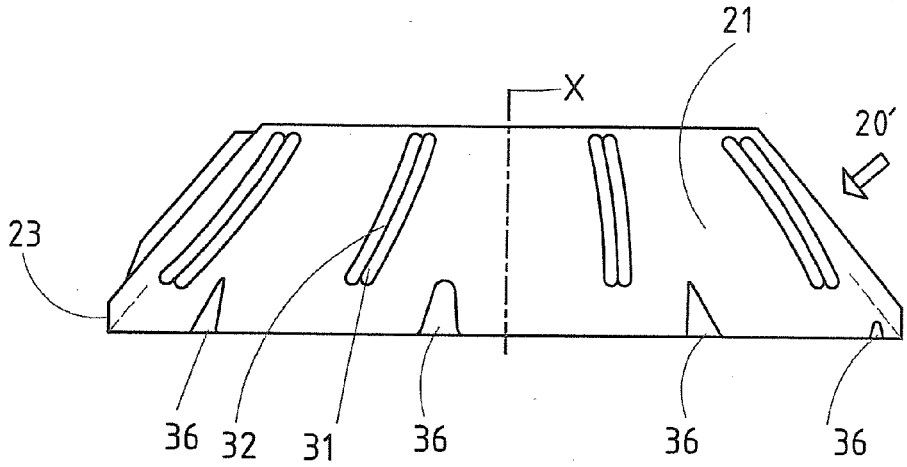
FIG. 4 discloses a side view of the separating disk in FIG. 3.
Figure 3:
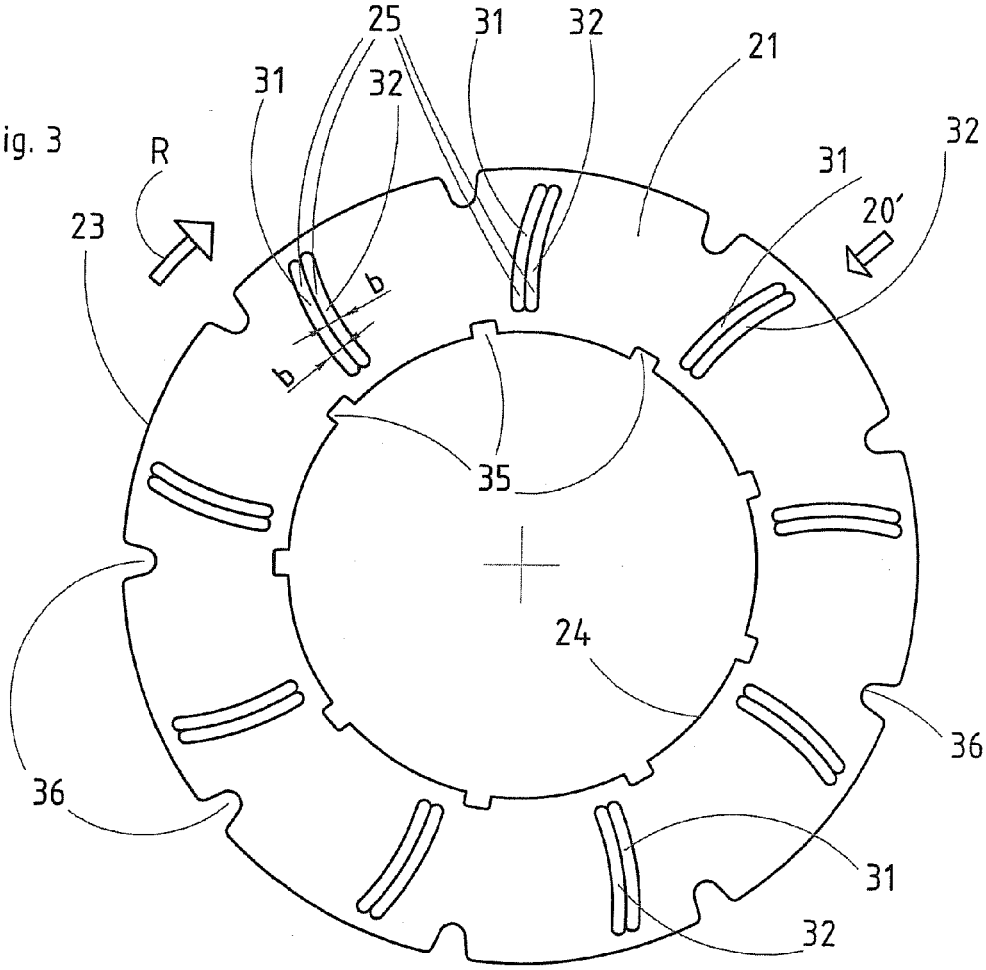
FIG. 3 discloses a view from above of a separating disk of the disk package according to a first embodiment.

In the first embodiment disclosed more closely in FIGS. 3-5, the distance members 25 are formed as protrusions in the material, wherein the tapering shape and the protrusions of the separating disk 20 have been produced through pressing of the blank against the tool part having a shape corresponding to the tapering shape with the protrusions of the pressed separating disk 20. In the first embodiment the distance members 25 comprise first distance members 25 in the form of first protrusions 31 and second distance members 25 in the form of second protrusions 32. The protrusions thus comprise a number of pairs of protrusions, wherein each of the pairs comprises a first protrusion 31 extending away from the outer surface 21 and a second protrusion 32 extending away from the inner surface 22. The first and second protrusions 31, 32 are displaced in relation to each other seen in a normal direction with regard to the outer surface 21. In the embodiment disclosed, the first and second protrusions 31, 32 are provided adjacent, or directly adjacent, to each other in a peripheral direction of the separating disk 20. It is possible to provide the distance members 25, i.e. in the embodiments disclosed the first and second protrusions 31, 32, in each pair at a significant distance from each other, for instance in such a way that a first protrusion 31 is located at the centre between two second protrusions 32. Possibly, the protrusions 31, 32 may then be given a more wide shape and in an extreme case extend substantially straight from the peak of a first protrusion 31 to the peak of the adjacent second protrusions 32, which means that there is no marked beginning or marked end of the distance members 25.

As can be seen in FIG. 5, the first protrusion 31 abuts the inner surface 22 of the adjacent separating disk 20, whereas the second protrusion 32 abuts the outer surface 21 of an adjacent separating disk 20. The first protrusion 31 will thus form a channel-like depression of the inner surface 22 and this depression is configured to collect and transport one of said components radially outwardly or inwardly on the inner surface 22. The second protrusion 32 forms, in a corresponding manner, a channel-like depression of the outer surface 21, wherein this depression is configured to collect and transport one of said components radially outwardly or inwardly on the outer surface 21. In the first embodiment, the second protrusion 32 is located after the first protrusion 31 with regard to the direction R of rotation. With regard to the outer surface 21, the channel-like depression thus precedes the upwardly projecting first protrusion 31. With regard to the inner surface 22, the channel-like depression instead follows the downwardly projecting second protrusion 32. Inverted relations arise if the direction of rotation is the opposite.

The first and second protrusions 31 and 32 have a height h above the outer surface 21 and the inner surface 22, respectively, see FIG. 5. This height h determines also the height of the interspaces 26 between the separating disks 20 in the disk package 19. Since the thickness t of the separating disks 20 may vary with the distance from the axis x of rotation, the first and second protrusions 31 and 32 may advantageously be configured in such a way that the height h varies with the distance from the axis x of rotation. As can be seen in FIG. 3, the distance members 25, i.e. the first and second protrusions 31 and 32, have an extension from a radially inner position to a radially outer position, wherein the height h varies along this extension in such a way that this varying height compensates for the varying thickness. In such a way a tight and uniform abutment between the first and second protrusions 31 and 32 against the inner surface 22 and the outer surface 21, respectively, can be ensured along the whole or substantially the whole extension of the protrusions 31, 32.

Depending on the actual press method, the thickness t of the separating disk 20 may increase with an increasing distance from the axis of rotation, wherein the height h decreases with an increasing distance from the axis x of rotation. The thickness t of the separating disk 20 may also decrease with an increasing distance from the axis x of rotation, wherein the height of the distance members 25 increases with an increasing distance from the axis x of rotation. It is to be noted that the varying height h can be provided in an advantageous manner since the separating disks 20 are manufactured in a press method and pressed against a tool part with a corresponding shape. The tool part can thus have projections and depressions, respectively, which are configured for the formation of the protrusions, and which have been given a varying height h in accordance with the applied press method in connection with the tool manufacturing.

The press method also makes it possible in an easy manner to let the extension of the protrusions 31, 32 be straight and radial or substantially radial, straight but inclined in relation to a radial direction, or curved at least if the protrusions 31, 32 are seen in the direction of the axis x of rotation. In the first embodiment the extension of the protrusions 31, 32 extends from in the proximity of the inner edge 24 to in the proximity of the outer edge 23.

The press method also makes it possible to configure the distance members 25, i.e. the first and second protrusions 31, 32, with a width at the inner surface and/or the outer surface 21 seen in a normal direction to the inner surface or the outer surface 21, wherein this width of at least some of the distance members 25 varies with the distance from the axis x of rotation.

Furthermore, the press method also enables the formation of stiffening folds or embossings (not disclosed) of the separating disks 20. Such folds may be straight or curved or extend in suitable directions.

Each of the first and second protrusions 31 and 32 comprises at least one contact zone 33 intended to abut the inner surface 22 and the outer surface 21, respectively, of an adjacent separating disk 20 in the disk package 19. As can be seen in FIG. 5, the contact zone 33 has a continuously convex shape seen in a cross section, in the first embodiment in a cross section transversally to a substantially radial direction. In the first embodiment, the contact zone 33 extends along the whole, or substantially the whole, extension of the first and second protrusions 31 and 32. With such a continuously convex shape of the contact zone 33 a small contact area between the contact zone 33 and the adjacent separating disk 20 is ensured, i.e. the contact area approaches zero. The contact zone 33 may in the first embodiment be defined to form a line abutment, or substantially a line abutment, against the inner surface 22 and the outer surface 21 respectively, of the adjacent separating disk 20 along the whole extension of the protrusions 31 and 32.

As can be seen in FIGS. 2 and 5, the separating disks 20 comprise first separating disk 20' and second separating disks 20". The first separating disks 20' comprise the first and second protrusions 31 and 32 which have been described above. The second separating disks 20" lack such protrusions, i.e. they comprise, or consist of, only one of the above mentioned portion without distance members 25. The second separating disks 20" thus have an even, or substantially even, tapering shape. The first and second separating disks 20' and 20" are provided in an alternating order in the disk package 19, i.e. every second separating disk 20 is a first separating disk 20' and every second separating disk is a second separating disk 20".

As can be seen in FIG. 3, each separating disk 20 comprises one or several recesses 35 along the inner edge 24. Such recesses may have the purpose of enabling a polar-positioning of the separating disks 20 in the disk package 19. Furthermore, each separating disk 20 comprises one or several recesses 36 along the outer edge 23. The recesses 36 may have the purpose of permitting transport of the medium through the disk package 19 and feeding of the medium into the different interspaces 26. It is to be noted that the recesses 35 and 36 may be advantageous for reducing the inherent stresses in the material in the pressed separating disk 20. The recesses 36 may be replaced by holes which in a manner known per se extend through the separating disk 20 and are provided at a distance from the inner and the outer edges 24, 23.

The separating disks 20 are polar-positioned in such a way that the first protrusions 31 of the first separating disks 20' are in line with each other in the disk package 19 seen in the direction of the axis x of rotation, see FIG. 5. Such a configuration of the disk package 19 is advantageous since it makes it possible to include a pre-tensioning in the disk package 19 when it is mounted. The second separating disks 20" will during the compressing of the disk package 19 be deformed elastically alternately upwardly and downwardly by the first and second protrusions 31 and 32 of the adjacent separating disks 20'. During operation of the centrifugal separator, forces arise in the second separating disks 20", which forces strive to straighten out the elastic deformation. Consequently, the abutment force between the separating disks 20 in the disk package 19 increases. In the embodiment disclosed, the first and second separating disks 20' and 20" have the same thickness t. However, it is to be noted that the first and second separating disks 20' and 20" may have different thicknesses t. Especially, the second separating disks 20", which lack protrusions, may have a thickness t which is significantly smaller than the thickness t of the first separating disks 20'. It is also to be noted that the height h of each distance member 25 of a first separating disk 20' varies in such a way that it compensates for the varying thickness t of the first separating disk 20' and for the varying thickness t of an adjacent second separating disk 20".

Figure 6:
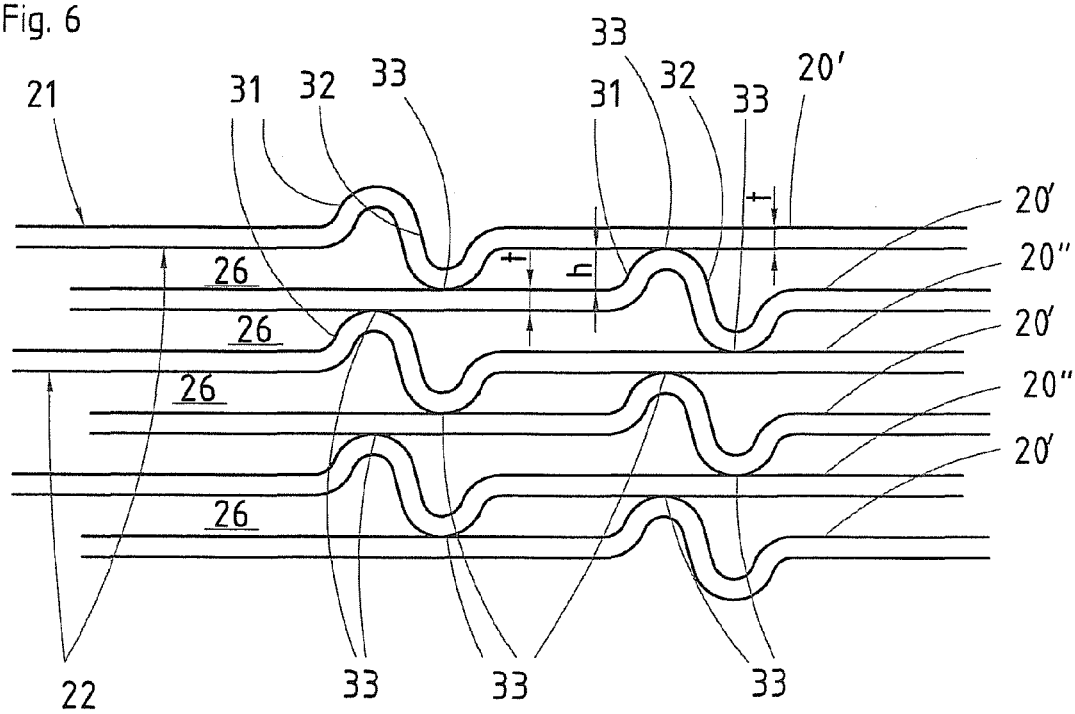
FIG. 6 discloses a section similar to the one in FIG. 5 of a part of a disk package according to a second embodiment.

According to a second embodiment of the disk package 19, see FIG. 6, also each second separating disk 20" may comprise a number of distance members in the form of pressed first and second protrusions 31 and 32, i.e. all separating disks 20 are provided with first and second protrusions 31 and 32. In this case, the separating disks 20 mat be polar-positioned in such a way that a first protrusions 31 of the first separating disks 20' are displaced in relation to the first protrusions 31 of the second separating disks 20" in the disk package 19 seen in the direction of the axis x of rotation.

It is to be noted here that for achieving the above mentioned pre-tensioning in the disk package 19, it is possible to provide the disk package 19 with distance members 25 which can not be deformed and for instance be formed by conventional distance members which are brazed or welded to the separating disks 20, but which are located in a corresponding manner as the first and second protrusions 31 and 32. Such conventional distance members may also have a continuously convex contact zone as has been described above.

Figure 7:
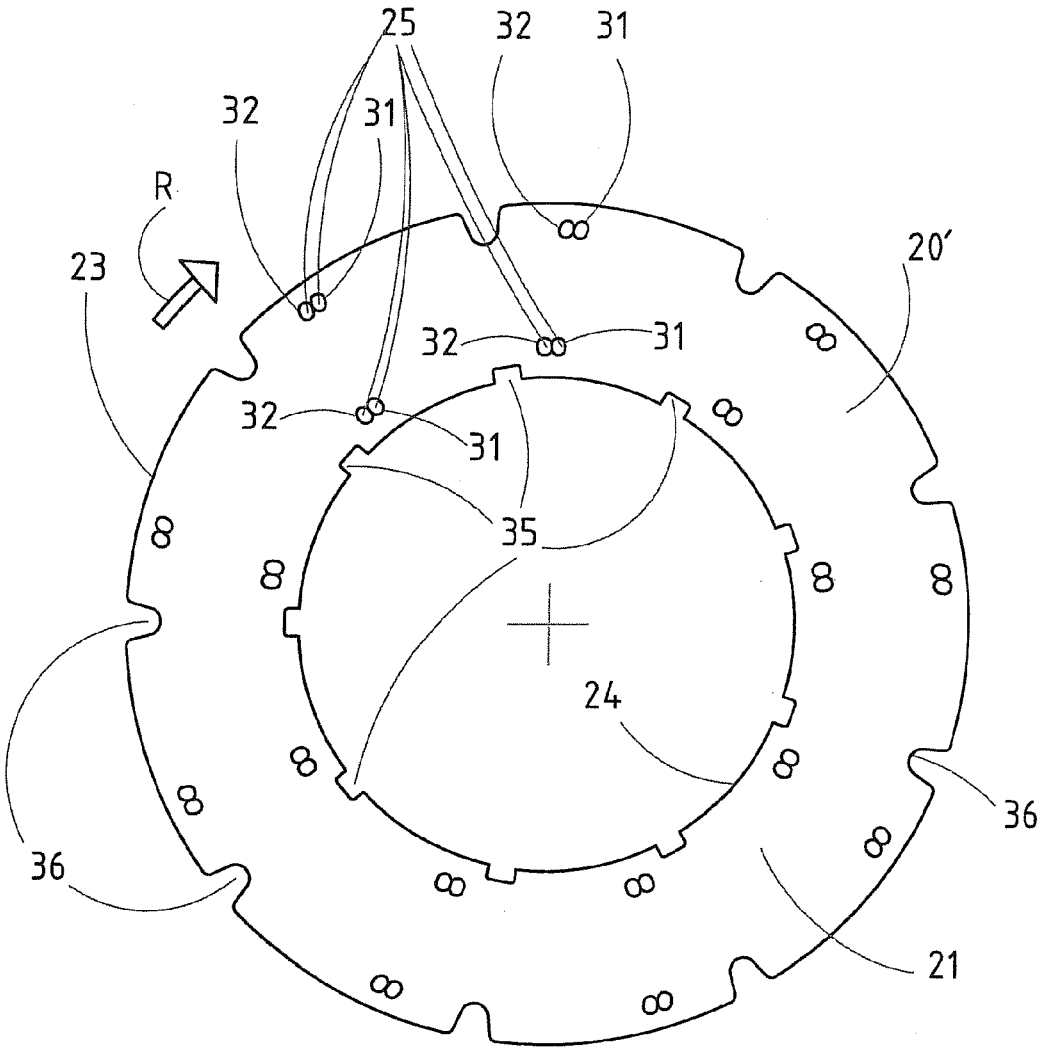
FIG. 7 discloses a view similar to the one in FIG. 3 of a separating disk according to a third embodiment.

FIG. 7 discloses a third embodiment where the distance members 25 have a spot-like extension. Also in this embodiment, the height of the distance members 25 may vary with the distance of the spot-like distance members 25 from the axis x of rotation. These distance members 25 may advantageously also be configured as first protrusions 31 extending away from the outer surface 21 and second protrusions 32 extending away from the inner surface 22. Each protrusion 31, 32 may advantageously have a continuously convex shape seen in a section transversally to a peripheral direction and transversally to a radial direction. In this embodiment, the contact zone 33 may be defined to form a point abutment, or substantially a point abutment, against the inner surface 22 or the outer surface 21 of the adjacent separating disk 20. The protrusions 31 and 32 are displaced in relation to each other and may be provided at a distance from or adjacent to each other. Moreover, it is to mentioned here that the separating disks 20 according to a further alternative may comprise both spot-like distance members 25 and elongated distance members 25.

Figure 8:
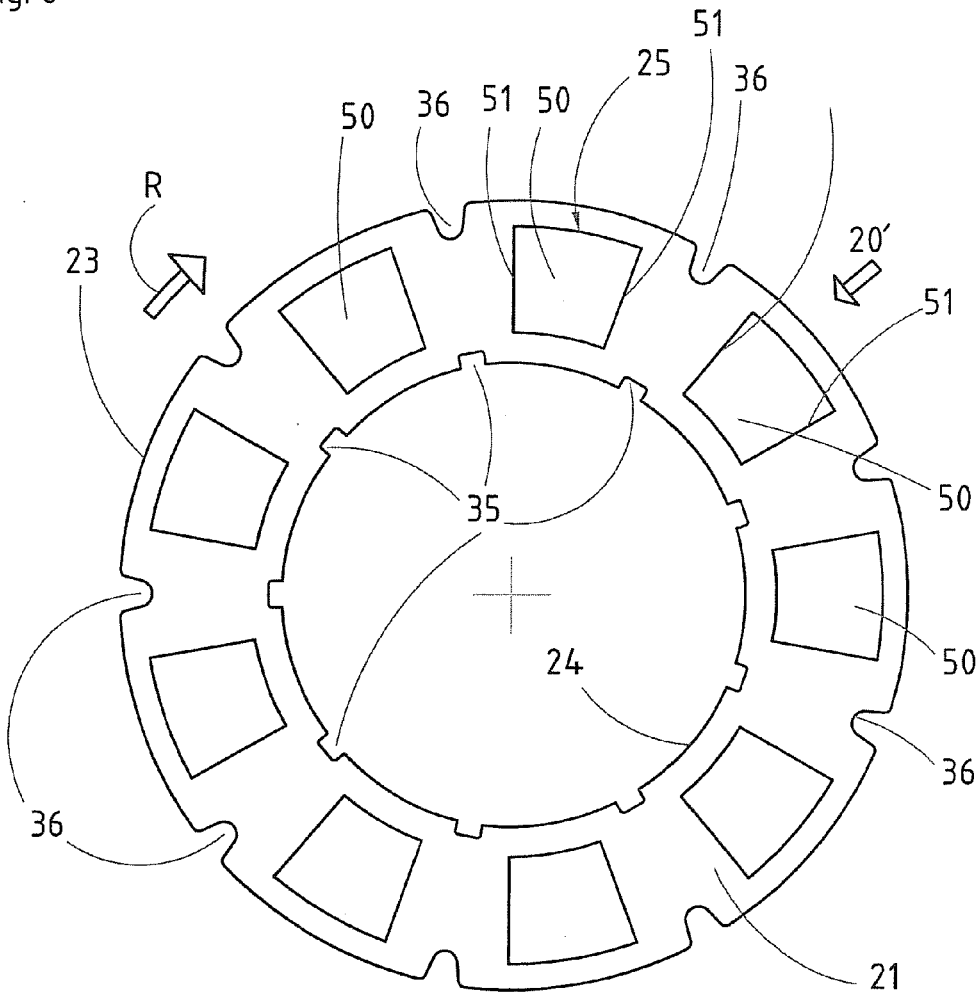
FIG. 8 discloses a view similar to the one in FIG. 3 of a separating disk according to a forth embodiment.
Figure 9:
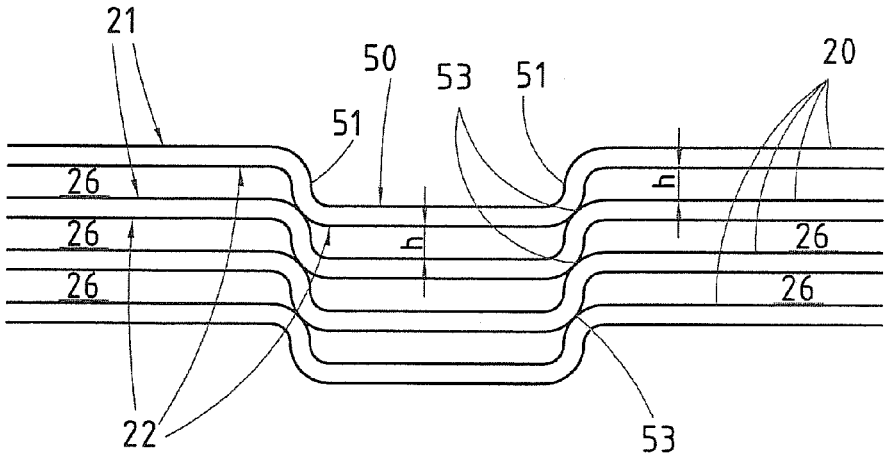
FIG. 9 discloses a section similar to the one in FIG. 5 through a disk package with separating disks according to the forth embodiment.

FIGS. 8 and 9 disclose a fourth embodiment of a pressed separating disk 20, where the distance members 25 are formed by protrusions 50 which all extends in the same direction away from the outer surface 21. Each protrusion 50 is delimited by two opposite side lines 51, which extend towards the outer edge 23 of the separating disk 20. In this embodiment, all separating disks 20, or substantially all separating disks 20, are identical. FIG. 9 discloses how the separating disks 20 are polar-positioned and abuts each other. In an area around each of the side lines 51, the protrusions 50 comprise a contact zone 53 on the outer surface 21 and a contact zone 53 on the inner surface 22. In the disk package 19, the contact zone 53 of a separating disk 20 abuts the contact zone 53 of an adjacent separating disk 20. Also here, each contact zone 53 has continuously convex shape seen in a cross section transversally to a substantially radial direction. The contact zones 53 extend along the whole, or substantially the whole, extension of the protrusions 50, and can be defined to form a line abutment, or substantially a line abutment, between the separating disks 20.

In the fourth embodiment, the protrusions 50 have substantially the same width as the areas between the protrusions 50. It is to be noted, however, that the width of the protrusions 50 also could be larger or smaller than the width of these areas. As can be seen FIG. 8, the protrusions 50 extend radially, or substantially radially from in the proximity of the inner edge 24 to in proximity of the outer edge 23. It is possible to let the protrusions 50 slope in relation to a radial direction and/or extend all the way to the inner edge 24 and/or all the way to the outer edge 23. Also according to the forth embodiment, it is possible to let the height of the protrusions 50 vary in order to compensates for a varying thickness of the pressed separating disk 20.

Figure 10:
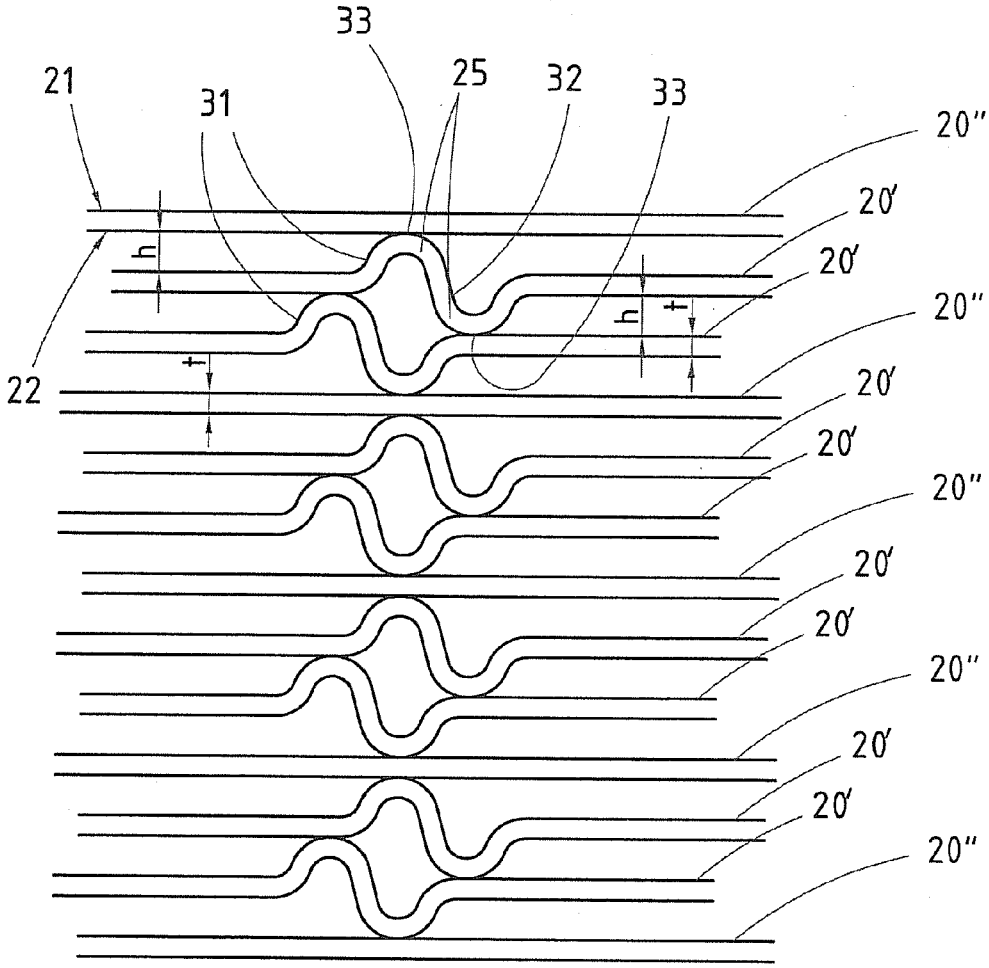
FIG. 10 discloses a section similar to the one in FIG. 5 through a disk package with separating disks according to a fifth embodiment.

It is to be understood that the polar-positioning of the separating disks 20 may be varied in many different ways in addition to the ways disclosed in FIGS. 5 and 6. FIG. 10 discloses a fifth embodiment where two first separating disks 20' are provided beside each other and each such pair of first separating disks 20' are separated by a second separating disk 20". The first protrusion 31 of a first separating disk 20' in such a pair lies opposite to the second protrusion 32 of the second first separating disk 20' in this pair, and opposite the first protrusions 31 of corresponding disks 20' in the remaining pairs.

Figure 11:
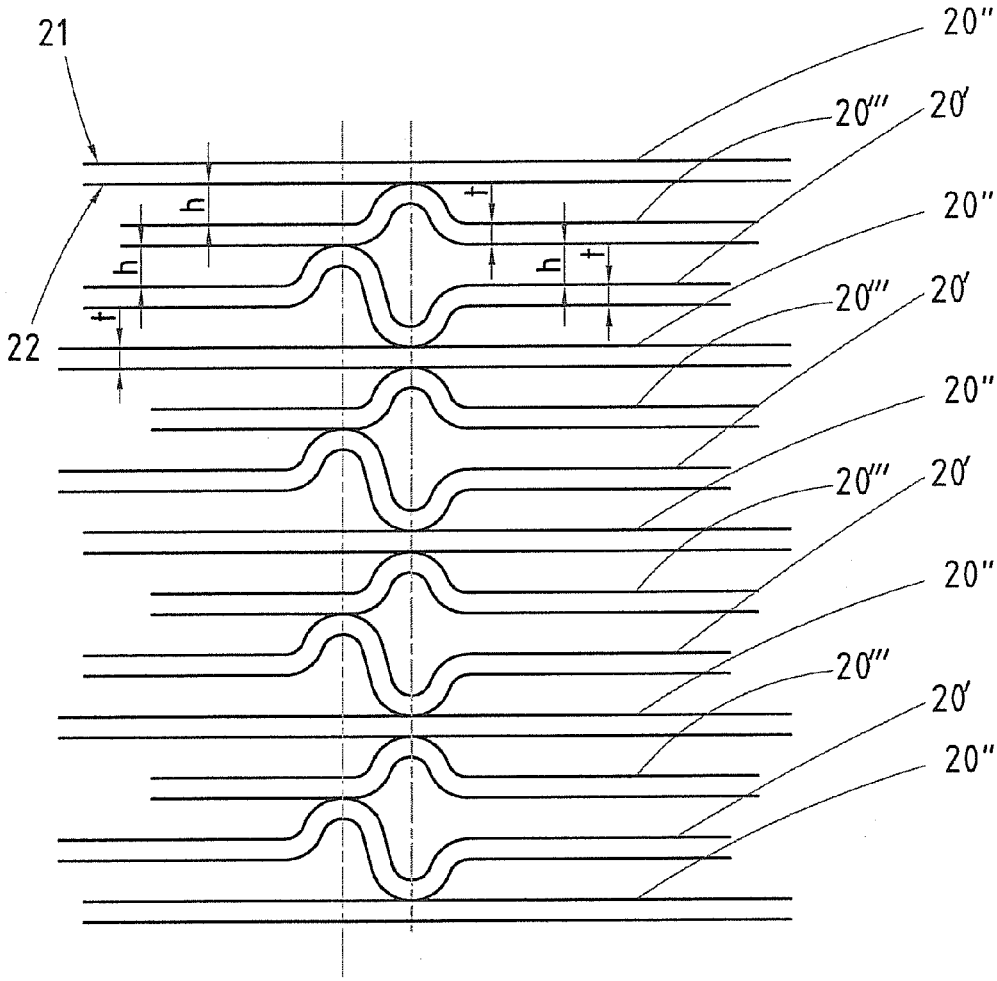
FIG. 11 discloses a section similar to the one in FIG. 5 through a disk package with separating disks according to a sixth embodiment.
Figure 12:
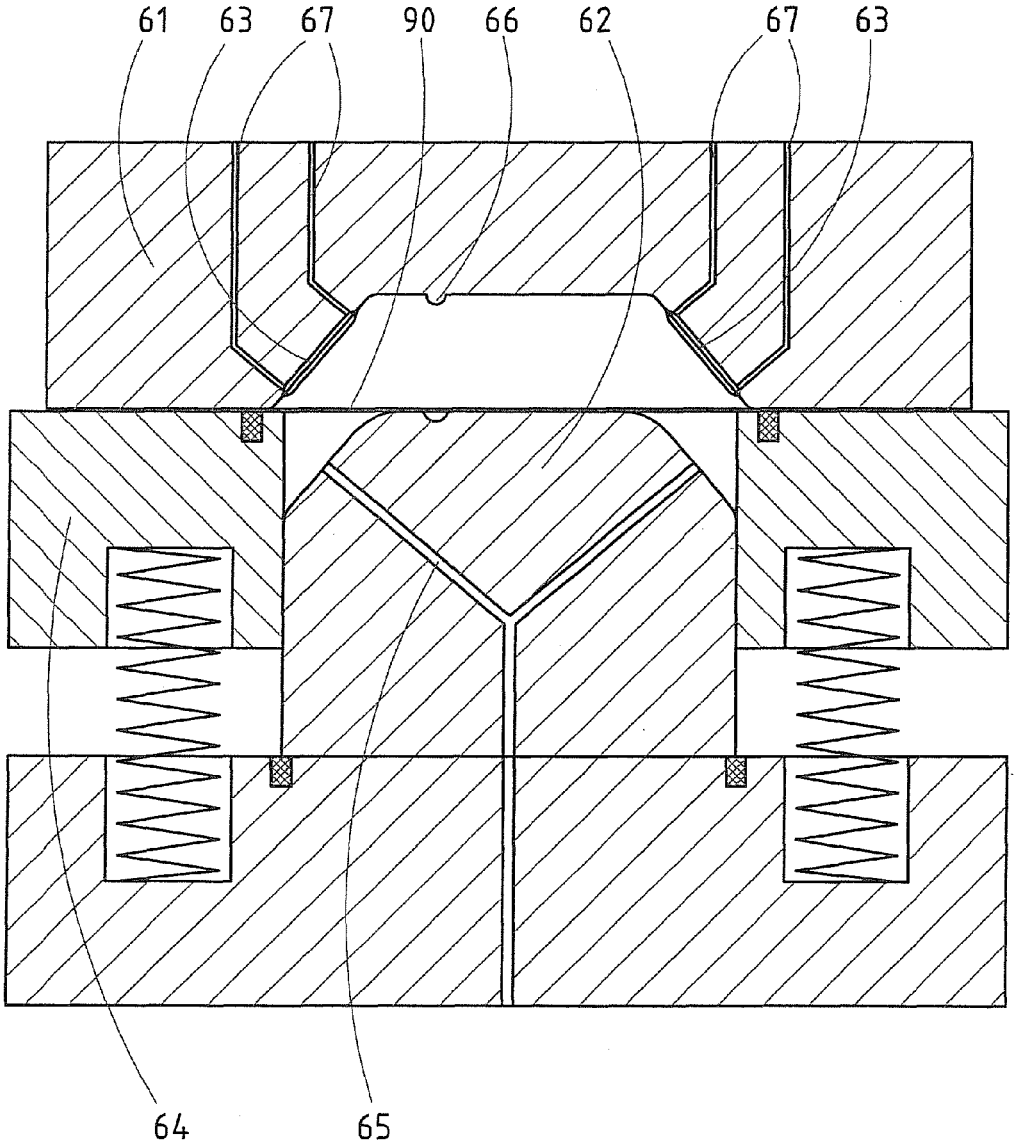
FIG. 12-14 discloses a sectional view of a first variant of a press tool for pressing a separating disk.
Figure 13:
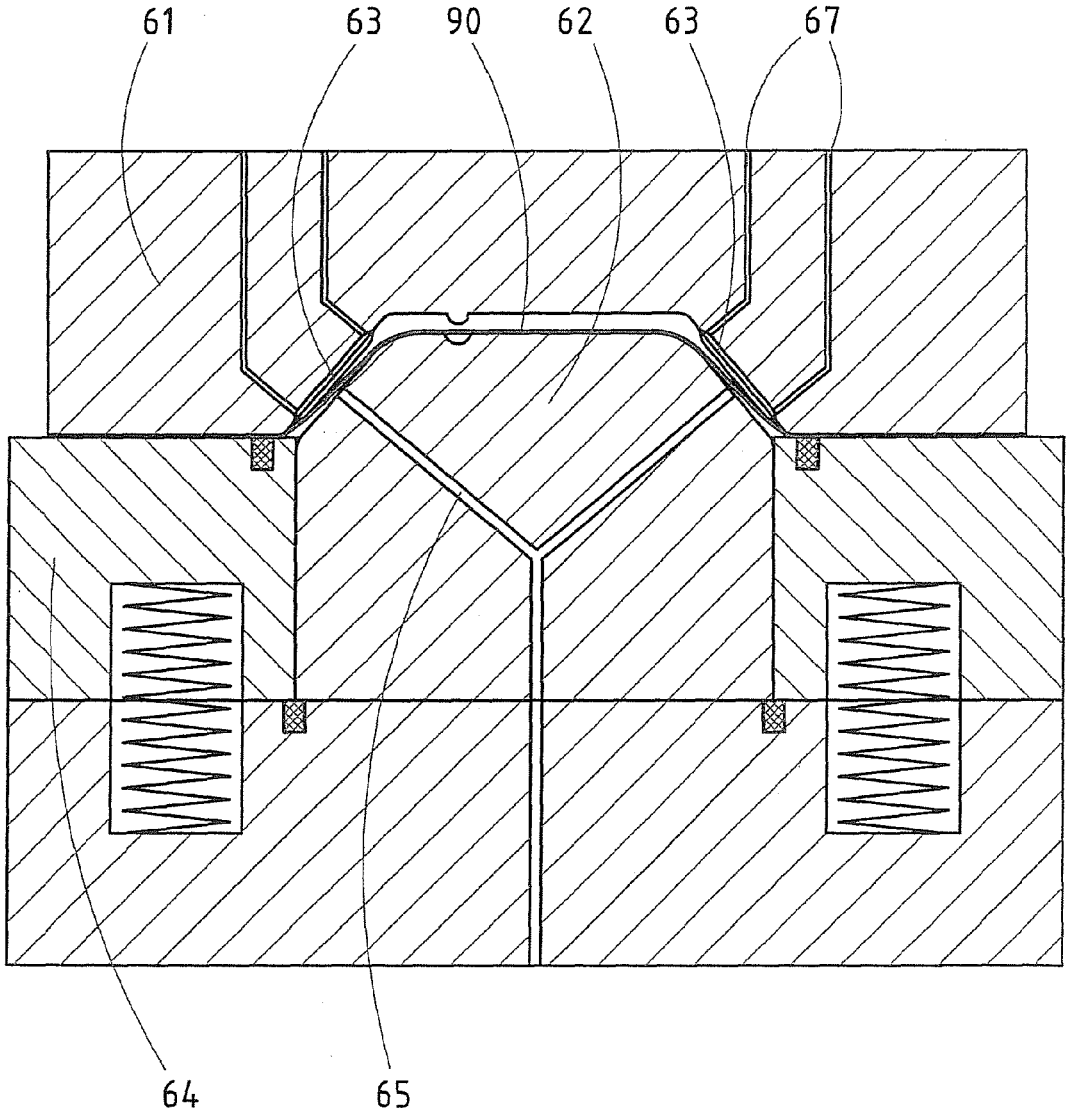
Figure 14:
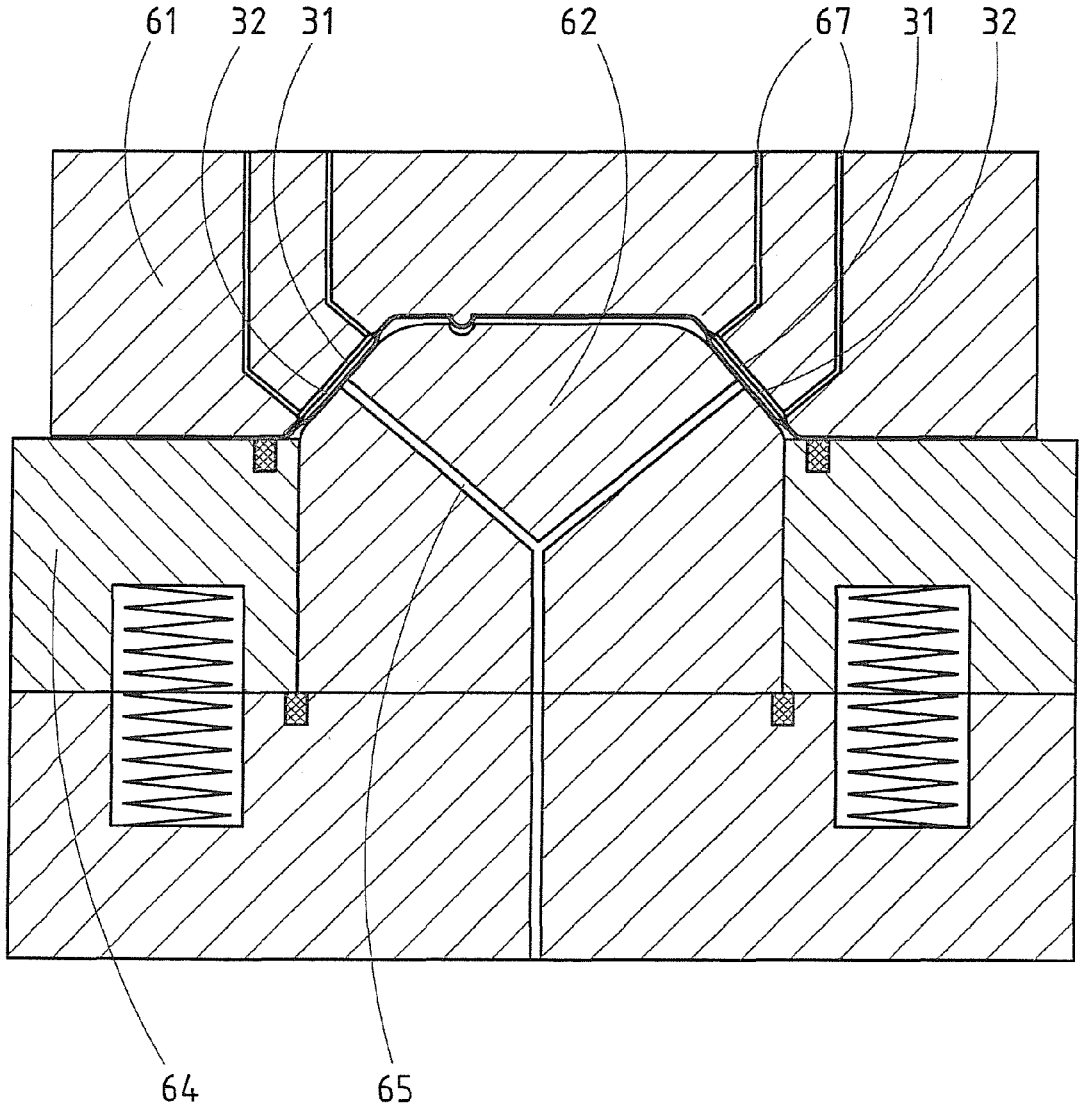

FIG. 11 discloses a sixth embodiment which is similar to the fifth embodiment, but differs from the latter since one of the first separating disks 20' has been modified and is a third separating disk 20" which comprises a first protrusion 31 but no second protrusion 32. The first protrusion 31 of the third separating disk in each pair lies opposite to the second protrusion 32 of the first separating disk 20' in each pair. In the fifth embodiment, a space which is closed in a cross-section is formed. Thanks to the absence of the second protrusion 32 of the third separating disk 20"', a lateral opening into this space is formed. It may also be mentioned that this closed space disclosed in FIG. 10 may be open at the ends through a variation of the length of the protrusions along their extension.

FIGS. 12 to 15 disclose a first variant of a press tool for manufacturing a separating disk as defined above. The press tool is intended to be introduced into a press (not disclosed) of a suitable design. The press tool comprises a first tool part 61 and a second tool part 62. The first tool part 61 has a concave shape against which the outer surface 21 of the separating disk 20 abuts after finished pressing. The first tool part 61 has a substantially plane bottom surface and a surrounding tapering side surface, in the example disclosed a surrounding substantially conical side surface. The first tool part 61 thus have a shape corresponding to the tapering shape of the pressed separating disk 20. In the case that the separating disk 20 is provided with protrusions 31, 32, 50, the first tool part 61 also comprises first from elements 63 which are located on the surrounding tapering side surface and which correspond to the shape of these protrusions, in the disclosed press tool, the protrusions 31 and 32. The press tool comprises, or is associated with, a holding member 64, which is arranged to hold the blank 90 to be pressed against the first tool part 61 with a holding force. If the separating disk 20 lacks protrusions a first tool part 61 without first form elements 63 is used.

Furthermore, the press tool comprises a supply device arranged to permit supply of a liquid at a pressure between the blank 90 and the second tool part 62. The supply device comprises channels 65 extending through the second tool part 62 through the surface of the second tool part 62 which faces the blank 90.

Figure 15:
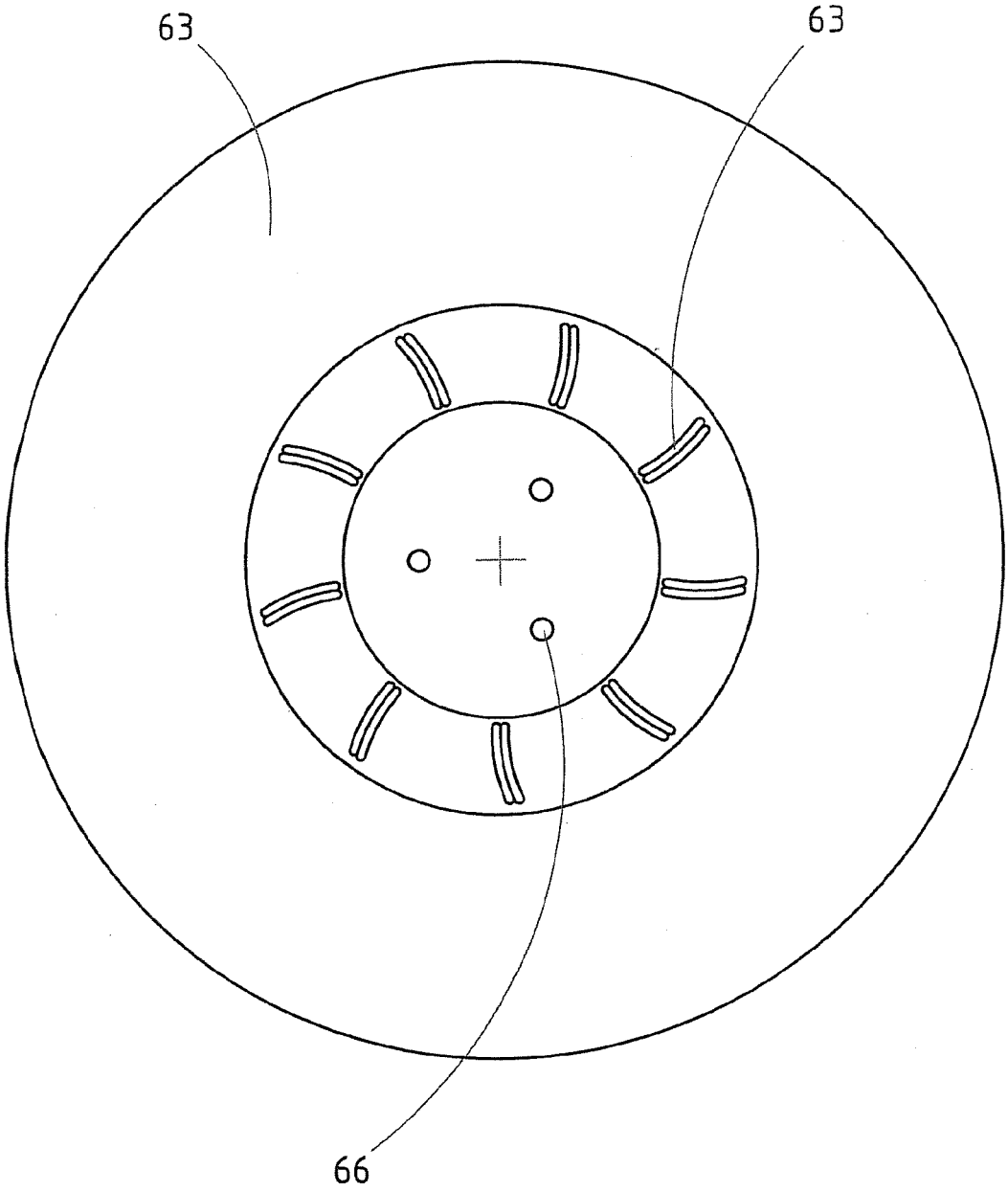
FIG. 15 discloses a plan view of a tool part of the press tool in FIGS. 12-14.

The first tool part 61 also comprises one or several second form elements 66, see FIG. 15, for forming a or several centering members of the pressed blank 90 in order to enable later centering of the blank 90 in connection with a subsequent processing of the blank 90. The form elements 66 are located on the bottom surface, which means that the centering members are provided in a central area of the blank 90. It is also imaginable to provide the centering members in an edge area of the blank 90, wherein corresponding second form elements will be located outside the tapering side surface.

Furthermore, the first tool part 61 comprises a plurality of evacuating passages 67 for evacuation of gas present between the blank 90 and the first tool part 61. The evacuating passages 67 have a very small flow area and are provided to extend through the bottom surface and the surrounding tapering side surface of the first tool part 61. Especially, it is important that there are evacuating passages 67 extending through these surfaces at the first form elements 63 forming the first and second protrusions 31 and 32, and at the second form elements 66 forming the centering member.

The press tool is arranged to permit, in a charging position, introduction of the blank 90 to be pressed between the first tool part 61 and the second tool part 62. Thereafter, the blank 90 is clamped between the first tool part 61 and the holding member 64 see FIG. 12. The first tool part 61 and/or the second tool part 62 are then displaced in a first part step in the direction towards each other to a final position, see FIG. 13. The first part step can be regarded as a mechanical press step. Thereafter, a liquid with a pressure is supplied in a second part step into a space between the blank 90 and the second tool part 62 through the channels 65 in such a way that the blank 90 is pressed to abutment against the first tool part 61 and takes its final shape, see FIG. 14. During the second part step, the gas present between the blank 90 and the first tool part 61 will be evacuated via the evacuating passages 67. The second part step can be regarded as a hydroforming step.

Figure 16:
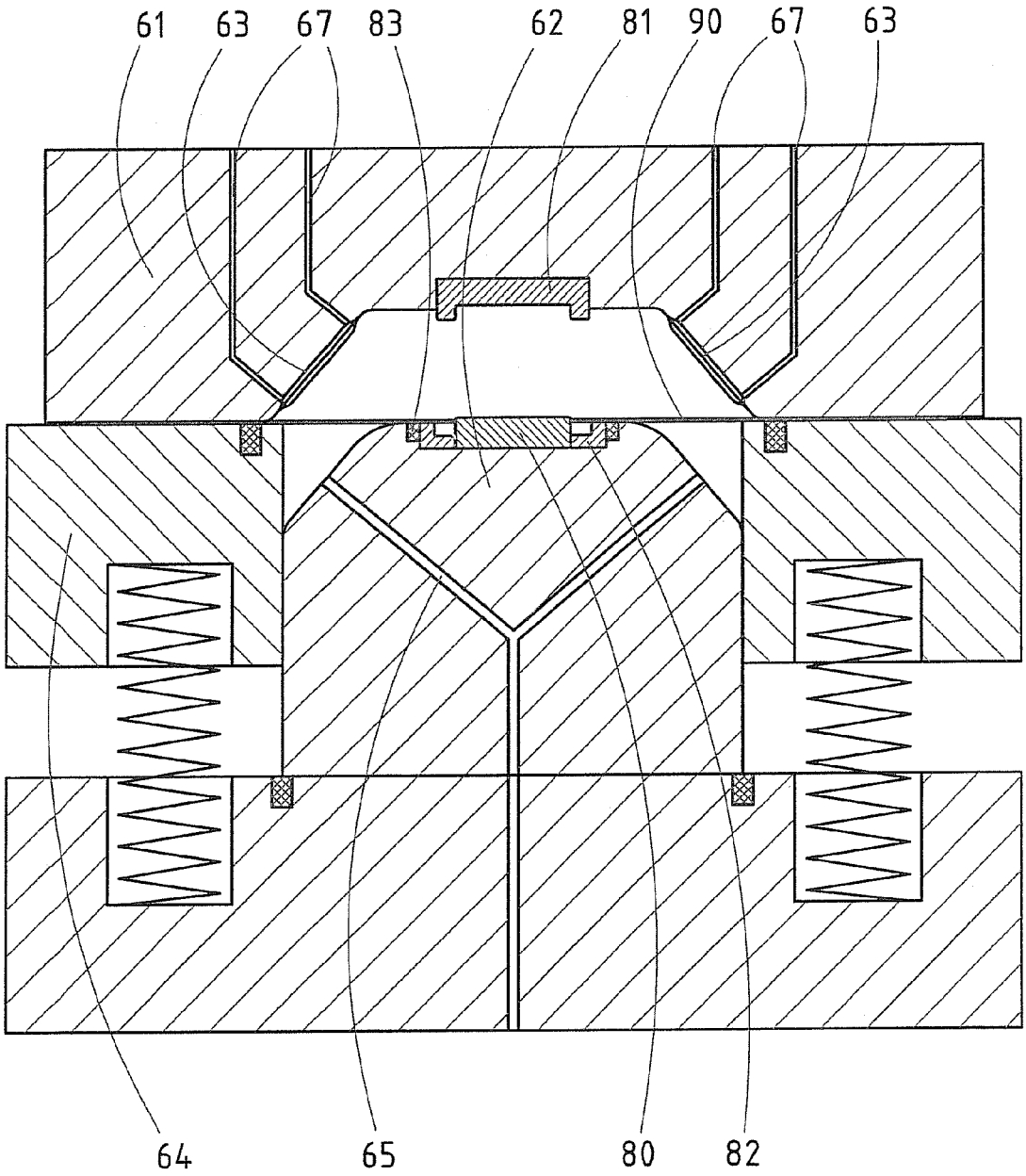
FIG. 16-18 discloses a sectional view of a first variant of a press tool for pressing of a separating disk.
Figure 17:
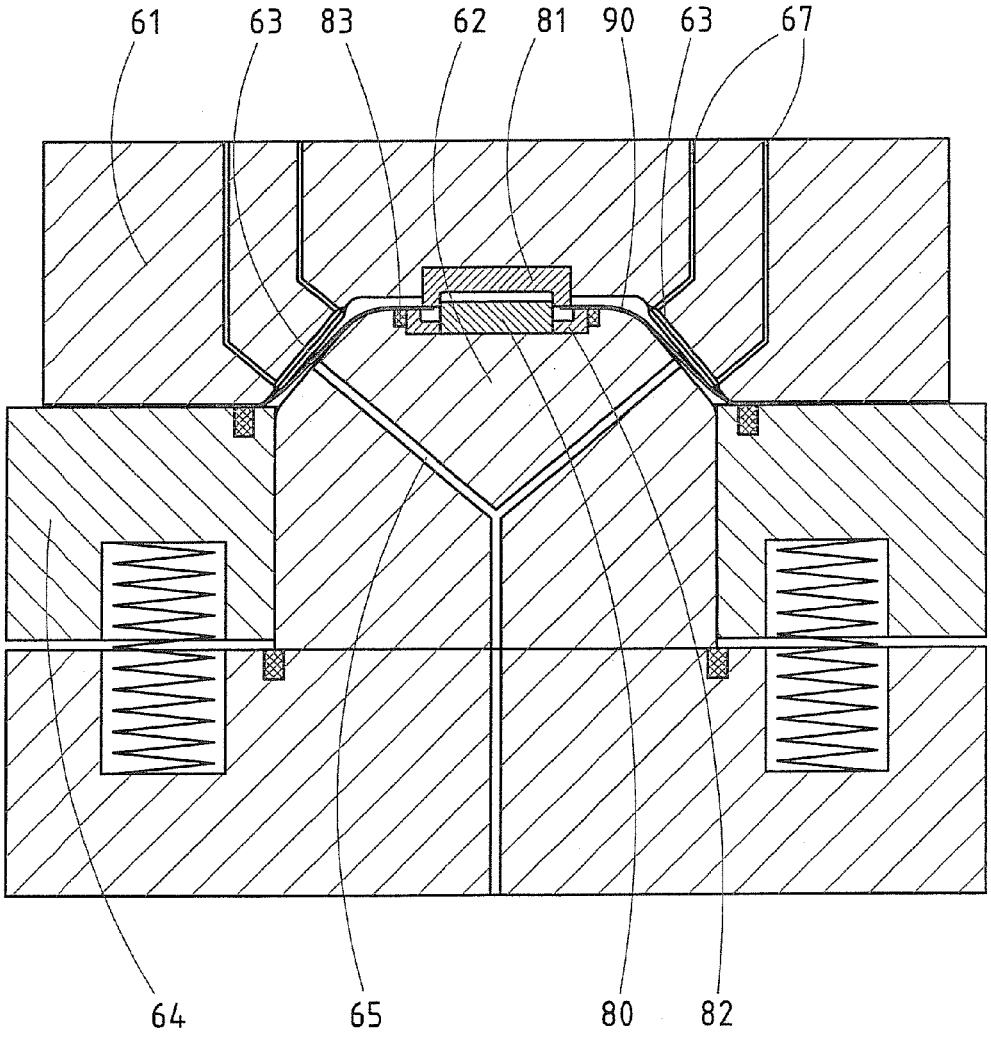
Figure 18:
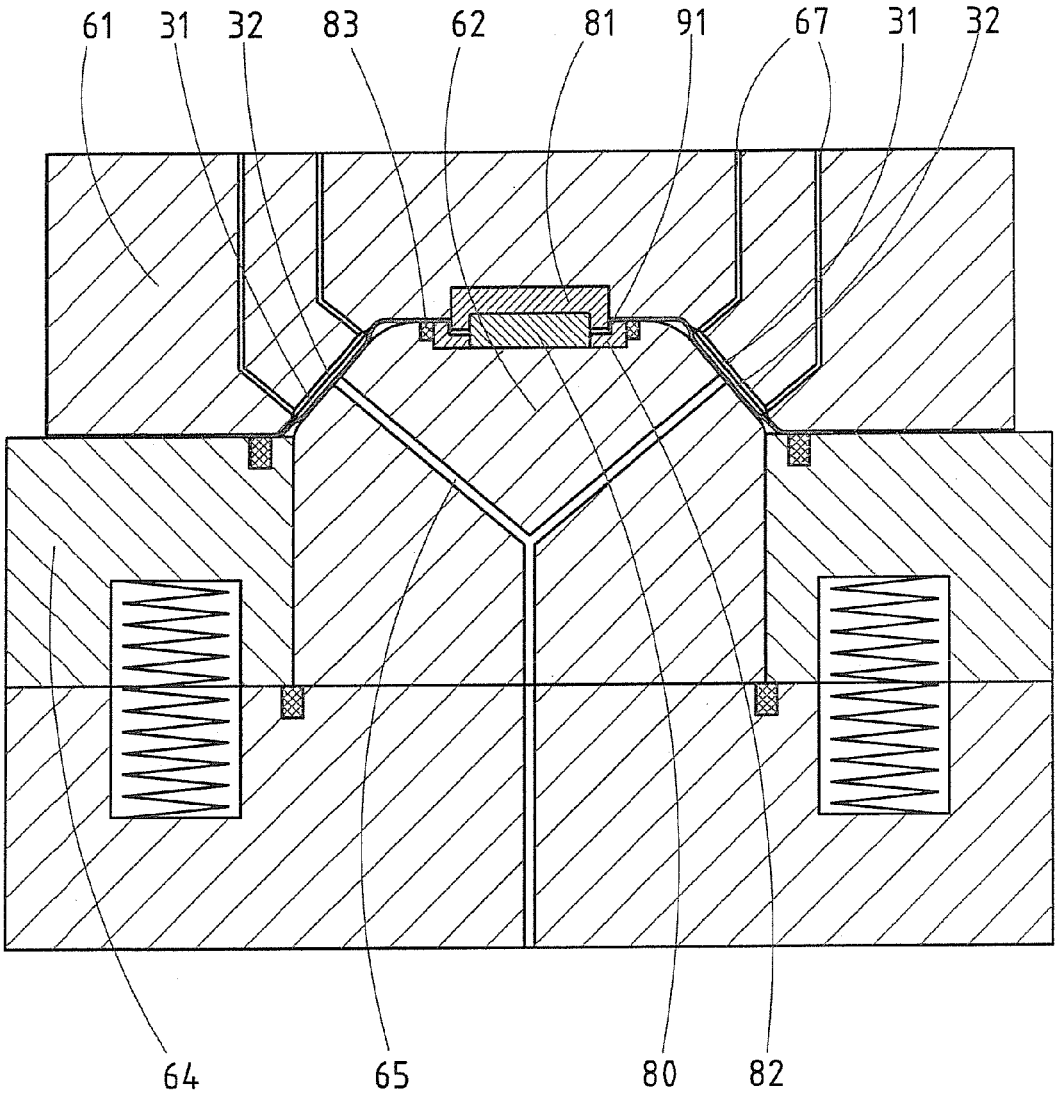
Figure 19:
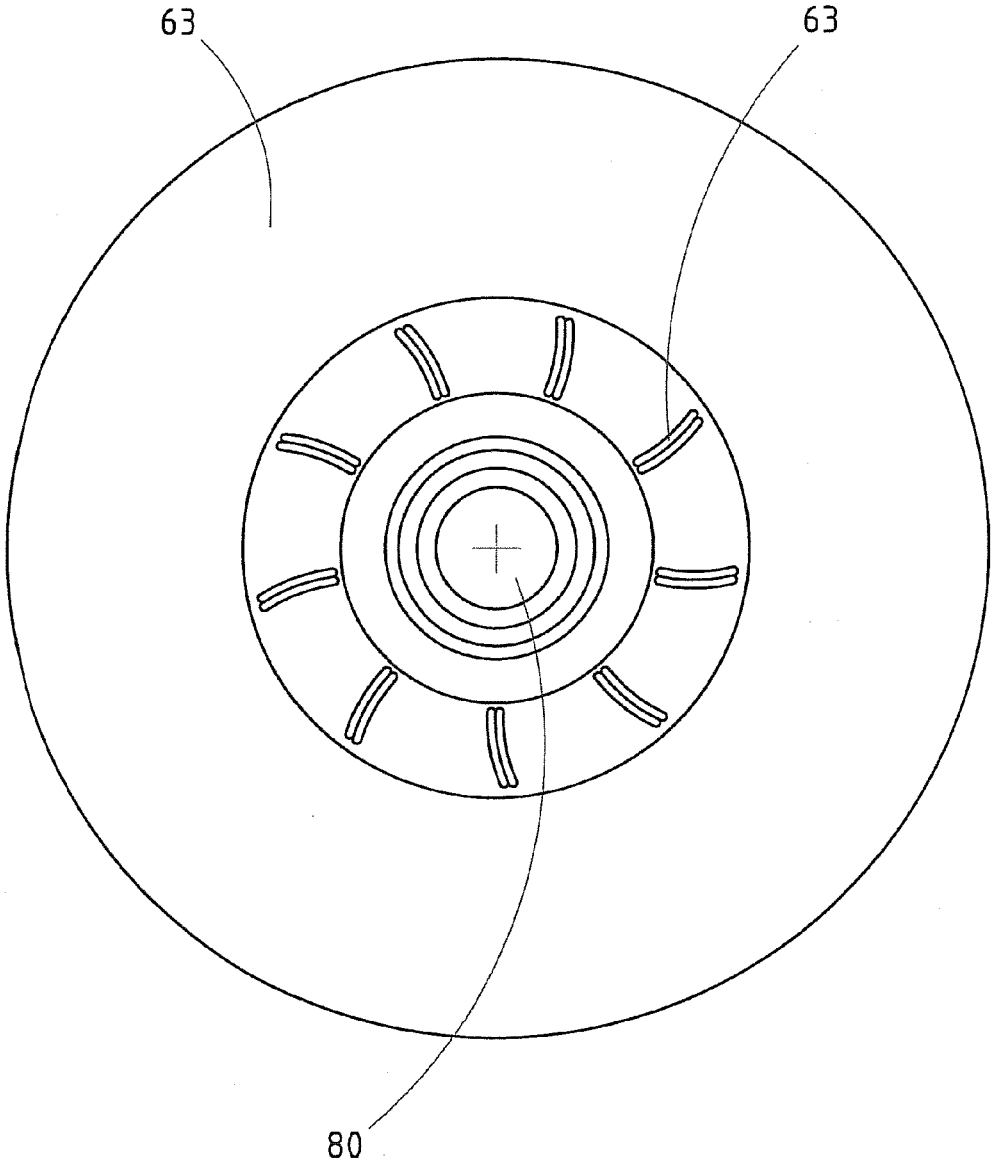
FIG. 19 discloses a plan view of a tool part of the press tool in FIGS. 16-18.

FIGS. 16 to 18 disclose a second variant of a press tool for manufacturing of a separating disk as defined above. The press tool is intended to be introduced in a press (not disclosed) of a suitable design. The press tool comprises a first tool part 61 and a second tool part 62. The first tool part 61 has a concave shape against which the outer surface 21 of the separating disk 20 abuts after finished pressing. The first tool part 61 has a surrounding tapering side surface, in the example disclosed a surrounding substantially conical side surface. The first tool part 61 thus has a shape corresponding to the tapering shape of the pressed separating disk 20. In the case that the separating disk 20 is provided with protrusions 31, 32, 50, the first tool part 61 also comprises first form elements 63, which are located on the surrounding tapering side surface and which correspond to the shape of these protrusions, in the disclosed press tool, the protrusions 31 and 32. The press tool comprises or is associated with a holding member 64 which is arranged to hold the blank to be pressed against the first tool part 61 with a holding force. If the separating disk 20 lacks protrusions, a first part tool 61 without first form elements 63 is used.

The second tool part 62 has a projecting central portion 80 arranged to extend through and engage a central opening of the blank 90 to be pressed. By means of this central portion 80, the blank 90 may be positioned in the press tool before pressing. The first and second tool parts 61 and 62 furthermore have a respective form element 81 and 82, respectively, which in co-operation with each other are arranged to form, when the first and second tool parts 61, 62 are moved towards each other, an area around the central opening in such a way that the material in this area forms a centering member 91 extending cylindrically, or at least partly cylindrically, and concentrically with the axis x of rotation, see FIG. 18. The second tool part 62 also comprises a sealing element 83, which is provided radially outside the projecting central portion 80. The sealing element 83 extends around the central portion at a distance from the latter. The sealing element 83 is arranged to abut sealingly the blank 90 around the central opening. The total press force is reduced thanks to the fact that the centre of the blank 90 inside the sealing element 83 has been masked and thus is not subjected to any pressing. The central portion 80, which positions the blank 90, will also permit guiding of the flow of material in the blank 90 in an initial stage of the pressing with regard to how much material is transported from the centre of the blank 90 and from the peripheral parts of the blank 90. The guiding of the flow of material can be provided by varying the size of the central opening and/or by varying the holding force.

Furthermore, the press tool comprises a supply device arranged to permit supply of a liquid at a pressure between the blank 90 and the second tool part 62. The supply device comprises channels 65 extending through the second tool part 62 through the surface of the second tool part 62 facing the blank 90.

Furthermore, the first tool part 61 comprises a plurality of evacuating passages 67 for evacuating gas present between the blank 90 and the first tool part 61. The evacuating passages 67 have a very small flow area and are provided to extend through the bottom surface and the surrounding tapering side surface of the first tool part 61. Especially, it is important that there are evacuating passages 67 which extend through these surfaces at the first form elements 63 forming the first and second protrusions 31, 32, and at the second form elements 66 forming the centering member.

The press tool is arranged to permit, in a charging position, introduction of the blank 90 to be pressed between the first tool part 61 and the second tool part 62 in such a way that the projecting central portion extends through the central opening. Thereafter, the blank 90 is clamped between the first tool part 61 and the holding member 64, see FIG. 16. The first tool part 61 and/or the second tool part 62 are then displaced in a first part step in a direction towards each other to a final position, see FIG. 17. The first part step can be regarded as a mechanical press step. Thereafter, a liquid at a pressure is supplied in a second part step into a space between the blank 90 and the second tool part 62 through the channels 65 in such a way that the blank 90 is pressed to abutment against the first tool part 61 and takes its final shape, see FIG. 18. The sealing element 83 then prevents the liquid from reaching the central opening. During the second part step, the gas present between the blank 90 and the first tool part 61 will be evacuated via the evacuating passages 67. The second part step can be regarded as a hydroforming step.

After the pressing, the blank 90 is removed from the press tool and transferred to any suitable processing machine (not disclosed). The blank 90 is centered in the processing machine by means of the centering member or members. The processing machine is then arranged to form, in a subsequent processing step, the inner edge 24 and the outer edge 23 of the separating disk 20.

This subsequent processing step comprises forming of the above mentioned one or several recesses 35 along the inner edge 24 and the above mentioned one or several recesses 36 along the outer edge 23. The subsequent processing step may comprise any suitable cutting or shearing operation.

It is to be noted that the first tool part 61 instead of a concave shape may have a convex shape, wherein the inner surface 22 of the separating disk 20 will abut the first tool part 61 after finished pressing.

It is to be noted that the separating disks 20 may be provided with a certain surface roughness on the outer surface and/or the inner surface. Such a surface roughness can be provided through a treatment in advance of the whole, or a part or parts of the outer surface 21 and/or the inner surface 22, for instance in that the actual surface is etched before the separating disk is pressed. The surface roughness will remain after the pressing. It is also imaginable to configure one or both tool parts 61, 62 with a surface roughness, wherein the pressing will provide the desired surface roughness of the actual surface of the outer surface and/or inner surface of the separating disk. Suitable examples of the surface roughness is disclosed in SE-B-457612. The roughness may thus comprise a plurality of flow influencing members having a certain height over the actual surface and a certain mutual distance. The relation between the certain height and the certain distance may lie in the interval 0.2-0.5. As indicated above, it is possible to provide selected parts with a roughness. Different parts of the actual surface may also have different roughness. Advantageously, only one of the outer surface 21 and the inner surface 22 is provided with a roughness. The protrusions 31, 32 suitably have no roughness as well as the surface portions against which the protrusions 31, 32 abut.

The invention is not limited to the embodiments disclosed but may be varied and modified with in the scope of the following claims. Especially, it is to be noted that the described separating disks may be used in substantially all kinds of centrifugal separators, for instance such where the centrifuge rotor has fixed openings for radial discharge of sludge, or intermittently openable such openings, see FIG. 1. The invention is applicable to centrifugal separators adapted for separation of all kinds of media, such as liquids and gases, for instance separating of solid or liquid particles from a gas.

What is claimed is:

1. A disk package for a centrifuge rotor of a centrifugal separator adapted for separation of components in a supplied medium, the disk package comprising:

a plurality of separating disks provided on each other in the disk package, wherein each separating disk extends around an axis (x) of rotation for the centrifuge rotor and has a tapering shape along the axis (x) of rotation with an inner surface and an outer surface, wherein each separating disk has an inner edge, which defines a central opening of the separating disk, and an outer edge, wherein each separating disk is manufactured of a material, wherein the separating disks comprise a plurality of first separating disks comprising a number of distance members, which extend away from at least one of the inner surface and the outer surface, wherein each separating disk comprises a portion without distance members on the inner surface and the outer surface, wherein each distance member comprises at least one contact zone which abuts an outer surface and an inner surface, respectively, of an adjacent separating disk in the disk package, wherein each distance member abuts one of said portions without distance members of an outer surface and an inner surface, respectively, of an adjacent separating disk in the disk package, the separating disks being pressed against each other with a pre-tensioning force in such a way that the distance members tightly abut said adjacent separating disk, and that the contact zone has a continuously convex shape seen in a section so that the contact zone has a contact area approaching zero.

2. A disk package according to claim 1, wherein each contact zone has an extension outwardly with respect to the axis (x) of rotation.

3. A disk package according to claim 2, wherein each distance member has an extension from in the proximity of but not from the inner edge to in the proximity of but not up to the outer edge.

4. A disk package according to claim 3, wherein the contact zone (33, 53) extends along substantially the whole extension of the distance member.

5. A disk package according to claim 2, wherein the extension of the distance member is straight.

6. A disk package according to claim 2, wherein the extension of the distance member is curved.

7. A disk package according to claim 1, wherein each distance member has a width at least one of the inner surface and the outer surface seen in a normal direction to said surface, and wherein the width of at least some of the distance members varies with the distance from the axis (x) of rotation.

8. A disk package according to claim 1, wherein each contact zone has a continuously convex shape seen in a section transversally to a peripheral direction.

9. A disk package according to claim 1, wherein the distance members comprise a number of pairs of protrusions which each comprises a first protrusion extending away from the outer surface, and a second protrusion extending away from the inner surface, wherein the first and second protrusions are displaced in relation to each other in a peripheral direction.

10. A disk package according to claim 9, wherein the first and second protrusions are provided adjacent to each other in the peripheral direction.

11. A disk package according to claim 10, wherein the first protrusion forms a channel-like depression of the inner surface and wherein this depression is configured to collect and transport one of said components radially outwardly or inwardly on the inner surface.

12. A disk package according to claim 10, wherein the second protrusion forms a channel-like depression of the outer surface and wherein this depression is configured to collect and transport one of said components radially outwardly or inwardly on the outer surface.

13. A disk package according to claim 9, wherein the tapering shape and the protrusions of the first separating disks have been provided through pressing of a blank of the material against a tool part which has a shape corresponding to the tapering shape with the protrusions of the pressed first separating disk.

14. A disk package according to claim 1, wherein the separating disks comprise a plurality of second separating disks and wherein the first and second separating disks are provided in an alternating order in the disk package.

15. A disk package according to claim 14, wherein the second separating disks lack distance members.

16. A disk package according to claim 1, wherein the distance members comprise protrusions extending in the same direction with respect to the outer surface and wherein each protrusion is delimited by two opposite side lines extending towards the outer edge of the separating disk.

17. A disk package according to claim 1, wherein at least one of the outer surface and the inner surface of the separating disks have a surface roughness.

* * * * *